US005613897A

United States Patent [19]

Thompson, Jr.

[11] Patent Number: 5,613,897

[45] Date of Patent: Mar. 25, 1997

[54] FOOT-PAD FLOOR CLEANING DEVICE

[76] Inventor: John P. Thompson, Jr., 1429 Caldwell St., Rossville, Ga. 30741

[21] Appl. No.: 512,659

[22] Filed: Aug. 8, 1995

[51] Int. Cl.[6] ..... B08B 7/00; B24B 1/00; A47L 13/282

[52] U.S. Cl. ..... 451/59; 15/227; 15/229.11; 134/6; 451/524

[58] Field of Search ..... 15/227, 210.1, 15/229.11, 229.12, 229.13, 231; 134/6, 42; 451/458, 490, 523, 524, 28, 59, 514, 515, 525

[56] References Cited

U.S. PATENT DOCUMENTS

| | | | |
|---|---|---|---|
| 2,071,365 | 2/1937 | Stroop | 15/227 |
| 2,075,229 | 3/1937 | Rose | 15/227 |
| 2,110,000 | 5/1938 | Kingman | 15/227 |
| 2,763,885 | 9/1956 | Lyons | 15/227 |
| 2,924,049 | 2/1960 | Spain | 15/227 |
| 3,460,182 | 8/1969 | Grande, Jr. | 15/227 |
| 3,526,014 | 9/1970 | Edwards | 15/227 |
| 3,680,170 | 8/1972 | Sims | 15/227 |
| 3,699,672 | 10/1972 | Sims | 15/227 |
| 3,885,249 | 5/1975 | De Brabander | 15/227 |
| 4,811,444 | 3/1989 | Hamblin | 15/227 |
| 4,924,608 | 5/1990 | Mongonye | 15/227 |
| 5,173,985 | 12/1992 | Palmer | 15/227 |

FOREIGN PATENT DOCUMENTS

| | | | |
|---|---|---|---|
| 880977 | 9/1971 | Canada | 15/227 |
| 400467 | 7/1909 | France | 15/227 |
| 268284 | 10/1929 | Italy | 15/227 |
| 131319 | 4/1929 | Switzerland | 15/227 |
| 150255 | 12/1931 | Switzerland | 15/227 |
| 05478 | 5/1990 | WIPO | 15/227 |

*Primary Examiner*—Tony G. Soohoo

[57] ABSTRACT

A shoe attachment device for cleaning marks from smooth surface floors includes an abrasive pad and a fastening mechanism attached thereto for removably fastening the abrasive pad to a shoe bottom. The abrasiveness of the pad being sufficient to remove scuff marks, but not sufficient to mar, remove, or diminish a floor's finish before a mark is completely removed.

4 Claims, 2 Drawing Sheets

FOOT-PAD FLOOR CLEANING DEVICE

BACKGROUND OF THE INVENTION

The present invention relates to floor cleaning devices, specifically a device for spot cleaning of marks from hard-surface, waxed floors. Such floors are present in many hospitals, schools, offices and public buildings. Most such floors are cleaned and then finish is applied. High speed buffers are used to shine the floors. These types of floors are particularly susceptible to scuff marks from hard-soled shoes. Previous methods of cleaning such marks have included manually scraping the marks away with a razor blade, scrubbing with a cleaning rag and cleaning solution, and scrubbing using a cleaning pad on the end of a wooden handle. Some of these methods dull the finish on the floor requiring further use of a high-speed buffer to restore the shine. There is no mechanized method for cleaning such scuff marks from the floors. Badly marked floors may require complete re-cleaning and re-buffing. This increases the cost of floor maintenance in all such institutions, either through the highly labor intensive manual cleaning of floor marks or through the complete re-treatment of the floors.

There are shoes designed for providing traction on wet floors, the sole of which comprises traction promoting material. These shoes cannot serve the purpose of this invention because they do not have features which provide the benefits of the objects listed herein below.

OBJECTS OF THE INVENTION

Objects and advantages of the present invention include:

(a) to provide a foot operated device for easily cleaning shoe scuff and other marks from hard surface floors.

(b) to provide such a device which cleans scuff marks without marring the finish on the floors.

(c) to provide such a device which is economical to fabricate and to use.

Further and other objects of the present invention will become apparent from the description contained therein.

SUMMARY OF THE INVENTION

In accordance with one aspect of the present invention, the foregoing and other objects are achieved by a shoe attachment device for cleaning marks from smooth surface floors which includes an abrasive pad and a fastening means attached thereto for removably fastening the abrasive pad to a shoe bottom, the abrasiveness thereof being sufficient to remove scuff marks, but not sufficient to mar, remove, or diminish a floor's finish before a mark is completely removed.

In accordance with another aspect of the invention, a method of removing marks from a floor includes the steps of:

a. fastening to at least one shoe a shoe attachment device for cleaning marks from smooth surface floors, which includes an abrasive pad and a fastening means attached thereto for removably fastening the abrasive pad to a shoe bottom, the abrasiveness thereof being sufficient to remove scuff marks, but not sufficient to mar, remove, or diminish a floor's finish before a scuff mark is completely removed;

b. bringing the abrasive pad into contact with the floor; and c. move the abrasive pad with scrubbing action to remove a scuff mark.

Figure 1:
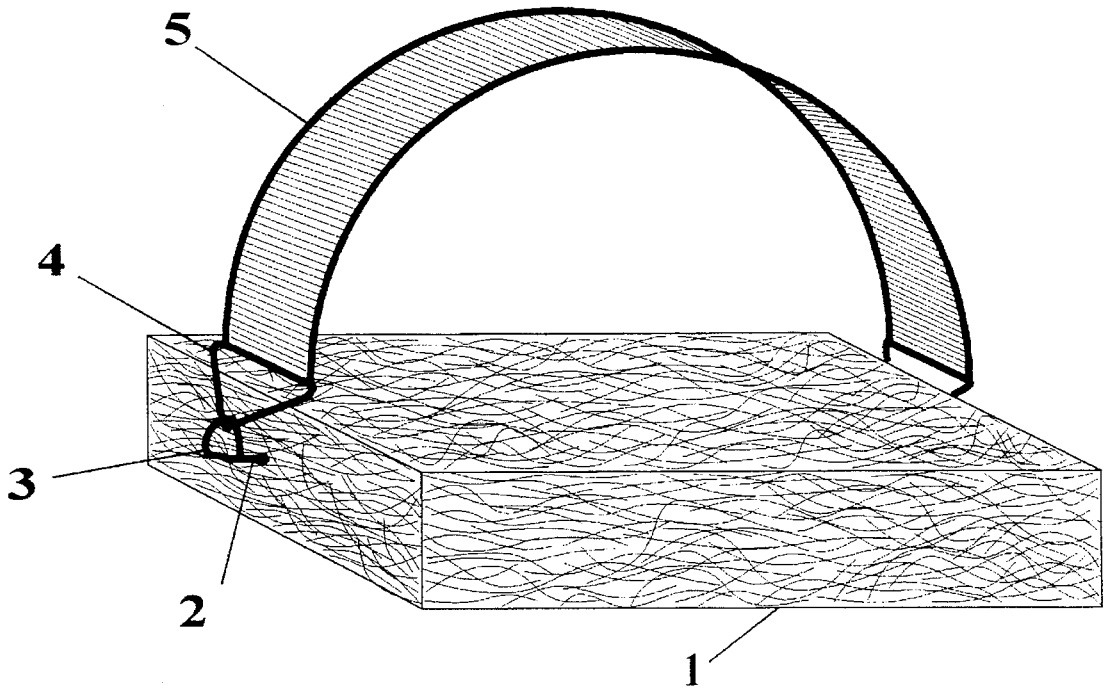
FIG. 1 is a perspective view of the footpad with the elastic band as the method for holding the pad on the shoe.
Figure 2:
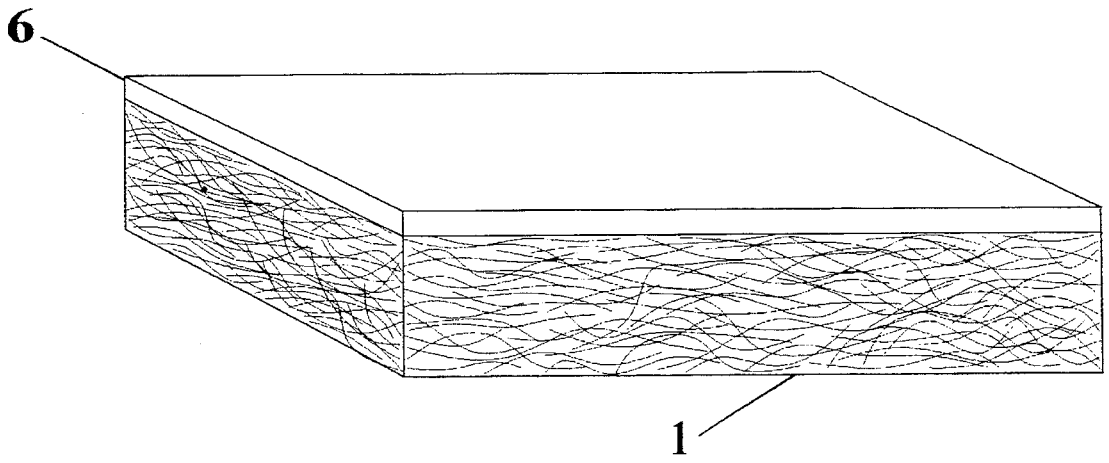
FIG. 2 is a perspective view of the footpad with an adhesive bonded to the upper surface of the abrasive pad.

For a better understanding of the present invention, together with other and further objects, advantages and capabilities thereof, reference is made to the following disclosure and appended claims in connection with the above-described drawings.

DETAILED DESCRIPTION OF THE INVENTION

The most preferred embodiment of invention is comprised of a non-woven fibrous pad 1 of roughly 3½ to 5 inches square. The pad 1 may be of any convenient shape, and larger or smaller, depending on foot/shoe size. The abrasive material is sufficiently abrasive to remove scuff marks, but not so abrasive so as to mar, remove, or diminish a floor's finish before the scuff mark is completely removed. A material found to be suitable for the pad is buffing pad material used with high speed floor buffers.

Fastening means are used to support the pad 1 against the bottom of the user's shoe. In a preferred embodiment, support means a stiff, usually steel holding wire 2, generally about 18 gauge, passes through the center of the pad 1. The wire 2 extends beyond the edges of the pad 1 to form loops 3 on either side thereof. These loops 3 are closed upon wire rings 4, generally about 0 gauge. The wire rings 4 serve as linking means, linking the loops 3 to the looped, closed ends of an expandable fabric strip, such as a woven elastic and/or adjustable band 5, usually about ½ to ¾ inches wide, thus linking the band 5 to the abrasive pad 1. The loops at the end of the expandable fabric strip are formed by doubling the ends of the expandable fabric strip back onto the strip and fastening the ends with in place on the strip with a fastener such as glue, staples, or stitches.

As described above and shown in FIG. 1, the opposite ends of the elastic or adjustable band 5 are attached via the wire rings 4 to the loops 3 at the ends of wire 2 which, in turn, extends through the pad 1 in a central region thereof that is located substantially between the opposite ends of the pad 1 and between the substantially parallel top and bottom surface regions of the pad 1. With this arrangement, the so attached elastic or adjustable band 5 can be easily stretched or adjusted to length which is sufficient to permit the user to pass the band 5 over either end of the pad 1 by rotating it about the rotational axis provided by the wire 2 so as to selectively position the band 5 over the abrasive top surface region of the abrasive pad 1 as shown in FIG. 1 or, alternatively, over the abrasive bottom surface region of the pad 1.

Alternatively, the band 5 can be attached to the abrasive pad 1 directly via stitching, without the use of the wire support means.

The user can place the bottom of a shoe on the pad 1, and tighten the band 5 over the top of the shoe to bind the device thereto.

In another embodiment, the fastening means comprises an adhesive layer 6 bonded to the upper face of the abrasive pad 1, to form a non-permanent bond with the sole of the wearer's shoe. Double sided tape is quite suitable for this function. The user can press the bottom of a shoe onto the adhesive layer to bind the device thereto.

As generally described above, the present invention is directed to the cleaning of hard surface floors in such a manner as to remove marks from the floors without marring or diminishing the finish of the floors. With scrubbing action with the foot having the device bound to the shoe thereon, remove marks, especially shoe scuffs, from floors.

While there has been shown and described what are at present considered the preferred embodiments of the invention, it will be obvious to those skilled in the art that various changes and modifications can be made therein without departing from the scope of the invention defined by the appended claims. It is expressly submitted that any of various known methods and/or devices which can employed in various ways to hold an object to a shoe bottom qualify as support means, and can be employed in the carrying out of the present invention without departing from the scope of the invention defined by the appended claims.

What is claimed is:

1. A shoe attachment device for removing marks from a floor surface without adversely affecting any finish on the floor surface consisting essentially of an abrasive pad formed of an abrasive material of sufficient abrasiveness for removing marks from a floor surface and defined by substantially parallel first and second surface regions facing opposite directions and spatially separated from one another by oppositely facing side regions and oppositely facing end regions, a wire extending through the abrasive pad at a central region thereof located substantially intermediate the first and second surface regions with opposite end portions of the wire protecting from said oppositely facing side regions, and a fastening means joined to the abrasive pad for removably fastening said abrasive pad to a shoe having top and bottom surface portions, said fastening means comprising an elongated band means for engagement with a shoe, said band means at least substantially extending over one of said first and second surface regions with opposite end regions of the band means being positioned adjacent to said opposite end portions of the wire, and securing means for joining the opposite end regions of the band means to opposite end portions of the wire, said band means being sufficiently variable in length to overlie the top surface portion of the shoe while maintaining the first or second surface region of the abrasive pad in contact with the bottom surface portion of the shoe.

2. A shoe attachment device for removing marks from a floor surface as claimed in claim 1, wherein said wire defines an axis of rotation for the band means, and wherein the band means are sufficiently variable in length to be rotated about the axis of rotation over one of the oppositely disposed end regions of the abrasive pad to selectively position the band means over said first surface region of the abrasive pad or said second surface of the abrasive pad.

3. A shoe attachment device for removing marks from a floor surface as claimed in claim 1, wherein each of the opposite end portions of the wire is provided with a loop, and wherein said securing means comprise a ring means supported in each loop and joined to each opposite end region of the band means.

4. A method of removing marks from a floor, comprising the steps of:

a. providing an abrasive pad having oppositely facing first and second surface regions formed of a material sufficiently abrasive to remove marks from the floor, and providing a band means connected through the pad such that the band means may be positionable over the first surface region or the second surface region for removably attaching the abrasive pad to the bottom of a shoe;

b. attaching the abrasive pad to the bottom of the shoe with the band means overlying the first surface region of the abrasive pad so as to position the second surface region of the abrasive pad in a contactable relationship with a mark on the floor;

c. bringing the first or second surface region of the abrasive pad into contact with a mark on the floor; and d. moving the abrasive pad with a scrubbing action to remove the contacted mark therefrom;

e. repositioning the band means while connected to the abrasive pad to overlie the second surface region of the abrasive pad;

f. attaching the abrasive pad to the bottom of the shoe so as to position the second surface region in a contactable relationship with a mark on the floor; and, g. repeating steps c and d.

* * * * *